United States Patent [19]

Cappel et al.

[11] Patent Number: 4,489,653

[45] Date of Patent: Dec. 25, 1984

[54] CLAMPING DEVICE FOR CLAMPING PRINTING PLATES ON THE PLATE CYLINDER OF A PRINTING MACHINE

[75] Inventors: Bert Cappel, Muhlheim; Kurt Difflipp, Dietzenbach; Helmut Emrich, Offenbach am Main; Horst Erbach, Hofheim; Wolfgang Feldt, Grundau; Klaus Neberle, Heusenstamm; Heinrich Ochs, Oberzell, all of Fed. Rep. of Germany

[73] Assignee: M.A.N.-Roland Druckmashinen Aktiengesellschaft, Fed. Rep. of Germany

[21] Appl. No.: 456,420

[22] Filed: Jan. 7, 1983

Related U.S. Application Data

[63] Continuation-in-part of Ser. No. 397,821, Jul. 13, 1982, abandoned.

[30] Foreign Application Priority Data

Jul. 13, 1981 [DE] Fed. Rep. of Germany ..... 3127586

[51] Int. Cl.[3] ..... B41F 1/28

[52] U.S. Cl. ..... 101/415.1

[58] Field of Search ..... 101/415.1, 378

[56] References Cited

U.S. PATENT DOCUMENTS

| | | | |
|---|---|---|---|
| 1,270,779 | 7/1918 | Brower | 101/415.1 |
| 1,948,038 | 2/1934 | Kast | 101/409 |
| 3,156,184 | 11/1964 | Shank | 101/415.1 |
| 3,460,443 | 8/1969 | Sarka et al. | 101/415.1 |
| 3,474,727 | 10/1969 | Kampf | 101/219 |
| 3,858,512 | 1/1975 | Simeth | 101/415.1 |
| 3,884,147 | 5/1975 | Abendroth | 101/378 X |
| 3,892,179 | 7/1975 | Jahn | 101/415.1 |
| 3,926,118 | 12/1975 | Preuss | 101/409 X |
| 3,973,496 | 8/1976 | Cerny et al. | 101/415.1 |
| 4,100,854 | 7/1978 | Fujishiro et al. | 101/415.1 |
| 4,259,904 | 4/1981 | Metje | 101/415.1 |

FOREIGN PATENT DOCUMENTS

| | | | |
|---|---|---|---|
| 611993 | 4/1935 | Fed. Rep. of Germany | 101/409 |
| 2200187 | 8/1972 | Fed. Rep. of Germany | 101/415.1 |
| 1200991 | 8/1970 | United Kingdom | 101/378 |
| 1284695 | 8/1972 | United Kingdom | 101/415.1 |

*Primary Examiner*—Paul T. Sewell
*Assistant Examiner*—M. J. Hirabayashi
*Attorney, Agent, or Firm*—Leydig, Voit, Osann, Mayer & Holt, Ltd.

[57] ABSTRACT

A clamping device for thin flexible printing plates has a tensioning rail at the trailing wall of a wide longitudinal groove in the plate cylinder. The tensioning unit is mounted for axial and peripheral adjustment on a support of "L" cross-section having a first leg seated with respect to the bottom of the groove and a second leg presenting an upstanding reference surface interposed between the tensioning rail and the trailing wall of the groove. A set of tensioning springs recessed in the tensioning rail bear against the reference surface and apply peripheral tension to the plate. A spring detent latches the tensioning rail temporarily against the reference surface, overcoming the tensioning springs while the trailing edge of the plate is being gripped. The spring detent is mounted upon and movable with the support. Screws having a plurality of selectable holes anchor the support in a series of peripheral positions for accommodation of plates of different length. A plurality of jack screws threaded into the tensioning rail have tips which bear against the reference surface on the support for removing slack from the plate and for tensioning of the plate about the surface of the cylinder.

11 Claims, 8 Drawing Figures

Fig. 1.
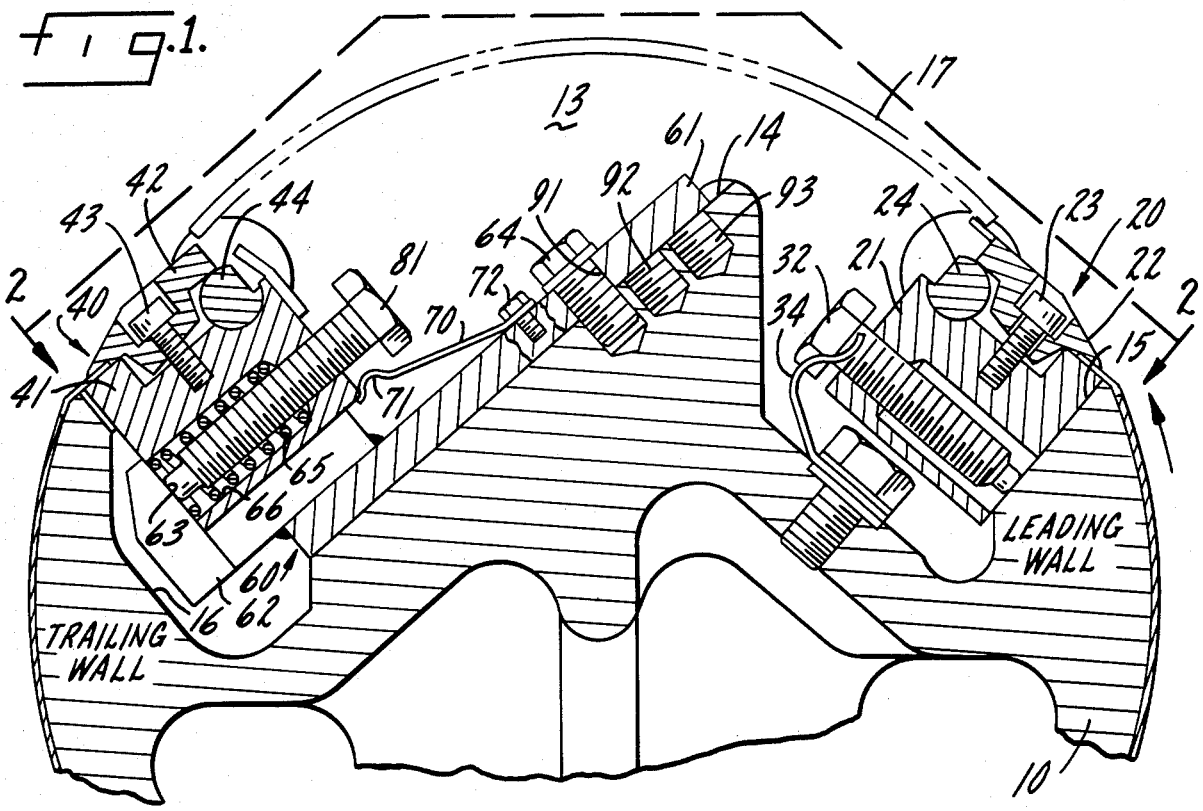
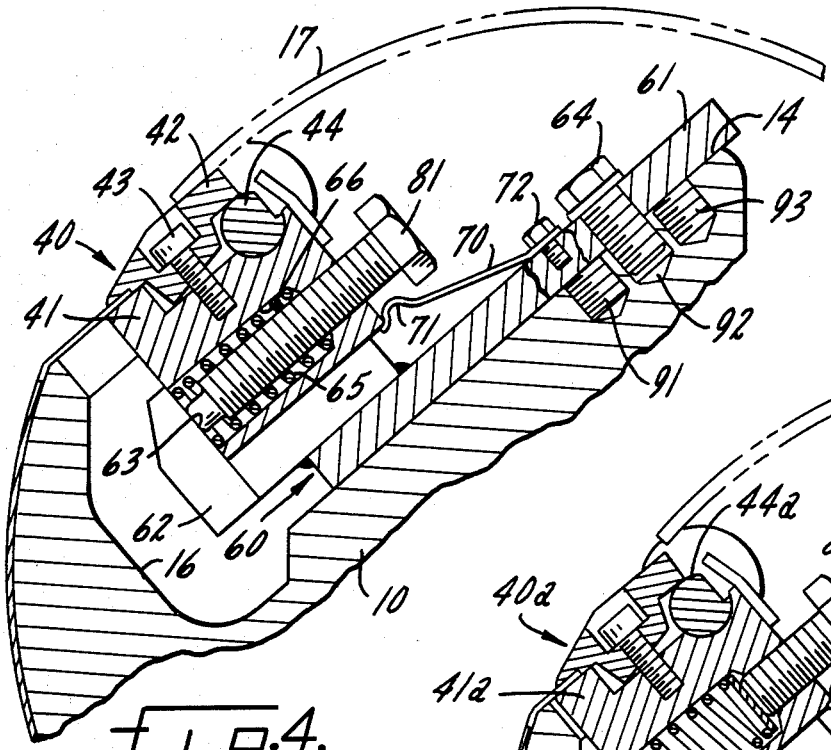
Fig. 4.
Fig. 6.
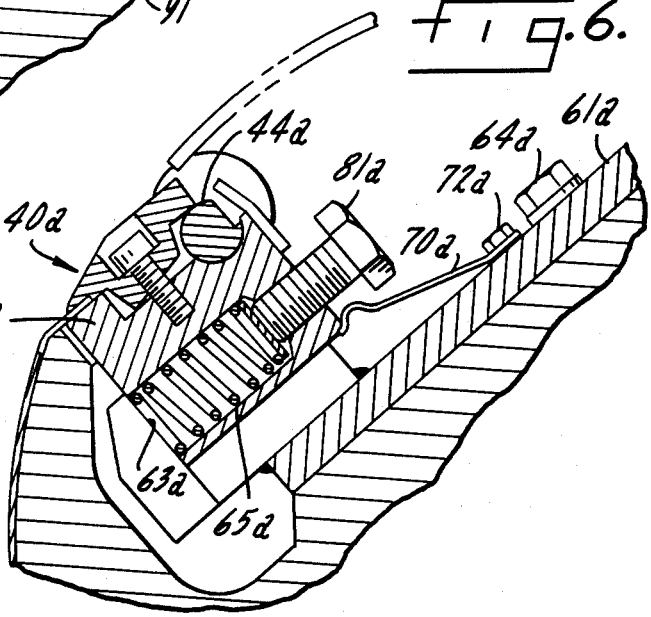

CLAMPING DEVICE FOR CLAMPING PRINTING PLATES ON THE PLATE CYLINDER OF A PRINTING MACHINE

This application is a continuation-in-part of application Ser. No. 397,821, filed July 13, 1982 now abandoned.

The art relating to the tensioned lockup of flexible printing plates is highly developed. In a conventional lockup the leading edge of the plate is clamped in a clamping rail and the trailing edge of the plate is clamped in a tensioning rail, the tensioning rail being movable and pressed in a peripheral direction by a series of tensioning or take-up springs so that the plate is kept under tension during operation of the press. An example is to be found in German laid-open document No. 22 00 187 dated Aug. 10, 1972. It is known in such devices to provide means for shifting the clamping rail to provide peripheral and axial register, respectively. By differentially adjusting the ends of the clamping rail, it is possible to impart a skew adjustment, in addition.

Nevertheless, the mounting of a flexible printing plate remains laborious and time-consuming, especially where it is necessary to accommodate plates of differing length.

It is, accordingly, an object of the present invention to provide a tension lockup for a flexible printing plate in which a plate may be mounted and adjusted, and subsequently removed, much more quickly and easily than has been possible in the past. It is another object to provide a tension lockup for a flexible plate which may more easily accommodate plates of differing length.

It is a general object to provide a tension lockup for a flexible printing plate which is strong and long-lived, which is free of maintenance problems, which is simple and economical in construction and which may be efficiently used by a pressman having limited skill and experience.

Other objects and advantages of the invention will be apparent upon reading the attached detailed description and upon reference to the drawings in which:

FIG. 1 shows, in cross-section, a tension lockup installation constructed in accordance with the present invention, as viewed along line 1—1 in FIG. 2.

Figures 2, 3, 3A, 5A, 5B:
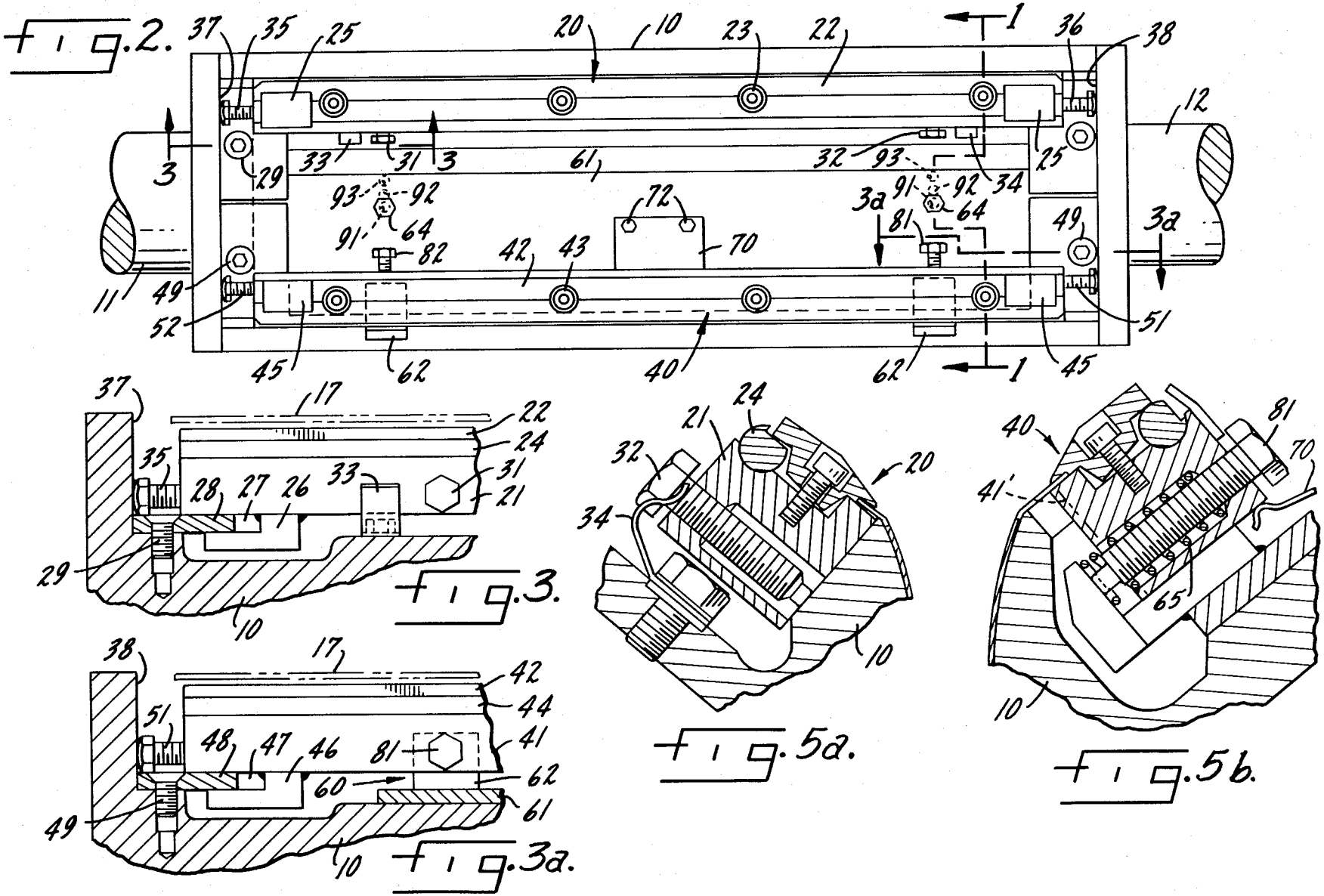
FIG. 2 is a plan view of the mechanism in FIG. 1 viewed along line 2—2 in the latter figure.
FIG. 3 is a fragmentary radial section taken along the line 3—3 in FIG. 2 showing retention and guidance of the clamping rail.

FIG. 3*a* is a similar view with respect to the tensioning rail taken along line 3*a*—3*a* in FIG. 2.

FIG. 4 shows a portion of FIG. 1 with the support for the tensioning rail set to accommodate a longer plate.

FIG. 5*a* shows the leading edge of a plate inserted in the clamping rail, the clamping jaw being released.

FIG. 5*b* is a view based on FIG. 1 but showing the result of turning of the trailing edge jack screws for removing slack from the plate and for overpowering the latch, the phantom lines showing the subsequent effect of the tensioning springs which operate constantly to tension the plate as the press is operated.

FIG. 6 is a sectional view, corresponding to a portion of FIG. 1, but showing a modified form of the present invention in which a jack screw engages the inner end of a tensioning spring to vary the applied tension.

While the invention has been described in connection with certain preferred embodiments, it will be understood that there is no intention to limit the invention to the embodiments disclosed but it is, on the contrary, intended to cover the various and alternative forms of the invention included within the spirit and scope of the appended claims.

In a typical lithographic printing press a thin flexible printing plate, usually of metal, is secured to the surface of a printing cylinder. Ink from an inking system is applied to etched areas on the plate. Water from a dampening system prevents the ink from clinging to the non-etched areas. The plate is in rolling engagement with a blanket cylinder having a smooth but resilient surface to which ink from the plate is applied or "offset". The blanket cylinder is, in turn, in rolling engagement with an impression cylinder. The feeding of a sheet between the blanket cylinder and the impression cylinder results in a printed image being applied to the sheet.

The present invention has to do with an improved form of plate cylinder which is distinguished by a tension lockup which grips the leading and trailing edges of the plate in a registered position and which acts to remove slack from the plate, keeping the plate under spring tension during a printing run.

Thus, referring to FIGS. 1 and 2 there is shown a printing cylinder 10 having stub shafts 11, 12, with a wide groove 13 axially formed in the cylinder surface. Assuming counterclockwise rotation, the groove 13 has a bottom wall 14, a leading wall 15, and a trailing wall 16. The groove 13 is covered, for protective purposes, by an arcuate shield 17 which is indicated in dot-dash outline.

Extending axially within the groove at the leading wall 15 is a clamping rail assembly 20 including a clamping rail 21 and a leading edge clamp 22 which is secured in place with a series of loosely fitted retaining screws 23 which provide retention and accommodation to rocking movement. Interposed between the clamping rail 21 and the rear end of the clamp 22 is a cam in the form of a flatted rod 24 rotated by actuators 25 (FIG. 2) at its ends.

For the purpose of positively retaining the clamping rail 21 in the cylinder in the face of centrifugal force while permitting limited movement in the peripheral and axial directions, the clamping rail is provided on its underside, at each end, with an L-shaped clip, or bracket, 26 (FIG. 3) which is securely welded to the rail and which provides a space 27 which captively registers with a retaining member, or guide, 28 which is held in place in the cylinder by means of one or more retaining screws 29.

For the purpose of peripherally registering the leading edge of the plate a pair of jack screws 31, 32 are threaded in the rail 21 so that the tips thereof engage the leading wall 15. For the purpose of biasing the rail 21 in the direction of the leading wall and to provide a force for the associated screw to work against, return springs 33, 34, in leaf form (FIGS. 1 and 2), are provided adjacent the respective adjusting screws 31, 32. Finally, to provide axial register at the leading edge of the plate screws 35, 36 are axially threaded into the ends of the clamping rail with their heads bearing against reference surfaces 37, 38 at the respective ends of the cylinder.

In accordance with the present invention a tensioning rail is located at the trailing wall mounted for peripheral movement and carrying a trailing edge clamp. The tensioning rail is mounted on a support of "L" cross-section having a first leg seated with respect to the bottom of the groove and having a second leg presenting an upstanding reference surface interposed between the tensioning rail and the trailing wall of the groove, a set of plate tensioning springs being arranged between the tensioning rail and the reference surface for applying peripheral tension to the trailing edge of the plate. A latch in the form of a spring detent is provided for latching the tensioning rail temporarily against the reference surface so as to overcome the force of the tensioning springs while the trailing edge of the plate is being gripped and with means for releasing the latch after the trailing edge of the plate is gripped so that the tensioning springs are free to constantly tension the plate about the surface of the cylinder.

Thus, referring to FIGS. 1, 2 and 3*a*, the tensioning rail assembly 40 includes a tensioning rail 41 carrying a trailing edge clamp 42 held in place by a series of screws 43 which are loosely fitted to permit rocking movement. A cam is provided in the form of a flatted rod 44 having actuators 45 at its respective ends.

Just as in the case of the clamping rail 21, the tensioning rail 41 has, at its ends, retaining clips, or brackets, 46 providing a space 47 in which a retaining member, or guide, 48 is held captive, the retaining member being secured to the cylinder by means of retaining screws 49. The retaining members permit peripheral movement of the tensioning rail 41 as well as axial movement, with the rail being axially positioned for register purposes, as will appear, by screws 51, 52 which abut the surfaces 38, 37, respectively, at the ends of the cylinder (FIG. 3*a*).

For the purpose of providing a support and reference for the tensioning rail, a support 60 of "L" cross-section is provided having a first leg 61 which is seated with respect to the bottom 14 of the groove and a second leg 62, extending at right angles thereto which presents an upstanding reference surface 63 interposed between the tensioning rail and the trailing wall 16 of the groove. The portion 61 of the support is held in position by a pair of mounting screws 64. Preferably the first leg 61 of the support is in the form of an extensive flat plate while the upstanding portion 62 (see FIG. 2) is formed in two axially spaced sections. For the purpose of applying tension to the trailing edge of the plate, a pair of plate tensioning springs 65 are recessed in bores 66 formed in the tensioning rail.

However, for overcoming the force of the tensioning springs and for latching the tensioning rail temporarily against the reference surface 63 while the trailing edge of the plate is being gripped, a spring detent 70 is provided in the form of a leaf spring having a rounded edge 71 which normally occupies an obstructing position with respect to the tensioning rail (see FIG. 1) and which is anchored cantilever-fashion by a pair of mounting screws 72 at its opposite edge. In use, prior to engaging the trailing edge of the plate, the tensioning rail 41 is moved against the reference surface 63, at which point the spring detent 70 springs upwardly into obstructing position, thereby to hold the tensioning rail bottomed against the reference surface 63 on the support, a position which ensures that slack will exist in the plate permitting easy insertion of the trailing edge of the plate into full engagement with the clamping member 42. The term "against" refers to proximity with or without actual contact.

Further in accordance with the invention jack screws are provided, threaded into the tensioning rail, for the purpose of moving the rail away from the reference surface to remove slack from the plate. Such screws are indicated at 81, 82, the screw 81 being visible in FIG. 1. The spring detent 70 can, at this point, be pressed downwardly to free the tensioning rail so that the plate tensioning springs are free thereafter to tension the plate about the surface of the cylinder. The term "means for releasing" as used herein includes the surface on the spring 70 which is manually pressed. Alternatively, the jack screws 81, 82 may be relied upon to overpower the spring detent, and to cam it downwardly into non-obstructing position, as the screws are rotated.

For accommodating the structure to plates of different length which are normally difficult to handle in a conventional plate lockup cylinder, the anchoring means for the support 60 includes a set of mounting screws with a plurality of selectable peripherally spaced openings for each screw. In addition, the spring detent is mounted upon, and movable with, the support 60 so that the latching function is the same for all adjusted positions of the support. Thus, referring to FIGS. 1 and 2, each mounting screw 64 for the support member 60 has available three selectable openings 91, 92 and 93 which are suitably threaded and which are spaced at incremental distances relative to the periphery of the cylinder. The mounting of the support for a longer plate is illustrated in FIG. 4 where the mounting screws 64 occupy the openings 92. It will be noted in this figure that moving the support to its alternate positions does not vary the relationship between the spring detent 70 and the tensioning rail.

In order to appreciate the benefits of the structure which has been described, a typical mounting and registering sequence is illustrated in FIGS. 5*a* and 5*b* taken in connection with FIG. 1. In FIG. 5*a* the leading edge of the plate is inserted, in full seated position, in the clamping rail 21, and the clamp is subsequently tightened by rotation of the flatted rod 24. Next, with the tensioning rail 41 seated against reference surface 63 on the support 60, and held in such position by the spring detent 70, the trailing edge of the plate is inserted into seated position under the clamp 42 and subsequently locked in place by rocking of the flatted rod 44 (FIG. 1).

Next, as shown in FIG. 5*b*, the jack screws 81, 82 are screwed in, which simultaneously removes initial slack from the plate and overcomes the spring detent 70, enabling the tensioning springs 65 to become effective to tension the plate about the surface of the cylinder.

The leading edge of the plate may be adjusted to a position of exact register in the peripheral direction by turning the screws 31, 32 as illustrated in FIGS. 2 and 5*a*, with any necessary skew being imparted by differential adjustment of the screws. Axial register adjustment at the leading edge of the plate may be obtained by differential adjustment of the screws 35, 36 at the ends of the clamping rail.

The tensioning springs 65 in the tensioning rail serve to provide continuous tensioning and takeup of the printing plate as the press is operated. Thus, as illustrated in phantom line 41' in FIG. 5*b*, it will be observed that the tip of the jack screw 81 has, during the first few revolutions, and in any event during the course of printing, separated from the reference surface 63 to place the associated springs 65 in control of the trailing edge of the plate. A certain amount of separation at the tips of the jack screws 81, 82 may take place immediately when the spring detent has been overpowered so that it is usually possible to operate the peripheral register adjustment at the leading edge of the plate without backing off the jack screws at the trailing edge.

An alternative form of the present invention is illustrated in FIG. 6 in which corresponding elements have been indicated by corresponding reference numerals with the addition of subscript "a". In this modification the outer end of the tensioning spring 65*a* bears against the reference surface 63*a* to produce tension in the plate, but the inner, or seated, end of the tensioning spring is engaged by the tip of the screw 81*a* to vary the amount of the tensioning force. The operating sequence may be substantially the same as that set forth in FIGS. 5*a* and 5*b*, in that screwing in of the screw 81*a* enables the tension spring 65*a* to develop sufficient force to overpower the spring detent 70*a*, following which the screw 81*a* may be adjusted backwardly or forwardly to establish the desired degree of running tension. Alternatively, the spring detent 70 may be manually released and the adjusting screws 81, 82 may be employed solely for purposes of determining the running level of tension in the plate.

Regardless of which version of the invention is employed, installation and removal of the plate can be accomplished more quickly and easily than where conventional flexible plate lockup mechanisms are employed. For the purpose of adapting the lockup mechanism to plates of differing length, all that is required is the removal and replacement of the pair of mounting screws 64, using the alternate holes provided, without affecting the operation of the spring detent or the force capable of being exerted by the tensioning springs.

It will be apparent to one skilled in the art that the described structure is not only efficient and easily operated but has in addition inherent strength and simplicity ensuring a long maintenance-free life.

We claim as our invention:

1. In a plate cylinder assembly for a printing press and intended for use with thin flexible printing plates of slightly different circumferential lengths, the combination comprising a plate cylinder formed with a longitudinal groove having a bottom, a leading wall and a trailing wall, a clamping rail at the leading wall, a leading edge clamp attached to the clamping rail for gripping the leading edge of the plate, a tensioning rail at the trailing wall mounted in the longitudinal groove for peripheral movement, a trailing edge clamp attached to the tensioning rail for gripping the trailing edge of the plate, a support for supporting the tensioning rail for relative movement, means adjustably mounting said support in said groove in a selected peripheral position with respect to the bottom of the groove for accommodating plates of differing circumferential lengths, said support being of "L"cross-section having a first leg seated with respect to the bottom of the groove and having a second leg presenting an upstanding reference surface interposed between the tensioning rail and the trailing wall of the groove, a set of plate tensioning springs arranged between the tensioning rail and the reference surface for applying peripheral tension to the trailing edge of the plate, resilient latching member mounted on said support for latching the tensioning rail temporarily against the reference surface for overcoming the force of the tensioning springs while the trailing edge of the plate is being gripped, and means for releasing the latch after the trailing edge of the plate is gripped so that the plate tensioning springs are free to tension the plate about the surface of the cylinder.

2. In a plate cylinder assembly for a printing press and intended for use with thin flexible printing plates slightly different circumferential lengths, the combination comprising a plate cylinder formed with a longitudinal groove having a bottom, a leading wall and a trailing wall, a clamping rail at the leading wall, a leading edge clamp attached to the clamping rail for gripping the leading edge of the plate, a tensioning rail at the trailing wall mounted in the longitudinal groove for peripheral movement, a trailing edge clamp attached to the tensioning rail for gripping the trailing edge of the plate, a support adjustably mountable in said groove for supporting the tensioning rail for relative movement, said support being of "L" cross-section having a first leg seated with respect to the bottom of the groove and having a second leg presenting an upstanding reference surface interposed between the tensioning rail and the trailing wall of the groove, a set of plate tensioning springs arranged between the tensioning rail and the reference surface for applying peripheral tension to the trailing edge of the plate, a latch for latchingly engaging and forcing the tensioning rail temporarily against the reference surface for overcoming the force of the tensioning springs while the trailing edge of the plate is being gripped, adjustable anchoring means for anchoring the support selectively in a series of peripheral positions with respect to the bottom of the groove for accommodation of plates of differing circumferential length, means mounting said latch upon the support so that the latching engagement of the latch with the tensioning rail is the same for all adjusting positions of the support, and means for releasing the latch after the trailing edge of the plate is gripped so that the plate tensioning springs are free thereafter to tension the plate about the surface of the cylinder.

3. In a plate cylinder assembly for a printing press and intended for use with a thin flexible printing plate, the combination comprising a plate cylinder formed with a longitudinal groove having a bottom, a leading wall and a trailing wall, a clamping rail at the leading wall, a leading edge clamp attached to the clamping rail for gripping the leading edge of the plate, a tensioning rail at the trailing wall mounted in the longitudinal groove for peripheral movement, a trailing edge clamp attached to the tensioning rail for gripping the trailing edge of the plate, a support for the tensioning rail mounted in the groove, said support being of "L" cross-section having a first leg seated with respect to the bottom of the groove and having a second leg presenting an upstanding reference surface interposed between the tensioning rail and the trailing wall of the groove, a set of plate tensioning springs biased against the tensioning rail for applying peripheral tension to the trailing edge of the plate, a latch in the form of a spring detent for latching the tensioning rail temporarily against the reference surface for overcoming the force of the tensioning springs while the trailing edge of the plate is being gripped, adjusting means for anchoring the support selectively in a series of peripheral positions with respect to the bottom of the groove for accommodation of plates of differing length, the spring detent being mounted upon the support so that the latching function is the same for all adjusted positions of the support, and means for overpowering the detent after the trailing edge of the plate is gripped so that the plate tensioning springs are free thereafter to tension the plate about the surface of the cylinder.

4. The combination as claimed in claim 3 in which the means for overpowering the detent includes a jack screw threaded into the tensioning rail and bearing against the reference surface.

5. The combination as claimed in claim 3 in which the spring detent is in the form of a leaf spring, anchored to the first leg of the support of "L" cross-section, which has a curved portion which engages the tensioning rail.

6. The combination as claimed in claim 2 or in claim 3 in which the adjustable anchoring means for the support includes a set of mounting screws plus means providing for each screw a plurality of selectable peripherally spaced openings.

7. In a plate cylinder assembly for a printing press and intended for use with a thin flexible printing plate, the combination comprising a plate cylinder formed with a longitudinal groove having a bottom, a leading wall and a trailing wall, a clamping rail at the leading wall, a leading edge clamp attached to the clamping rail for gripping the leading edge of the plate, a tensioning rail at the trailing wall mounted in the longitudinal groove for peripheral movement, a trailing edge clamp attached to the tensioning rail for gripping the trailing edge of the plate, a support for the tensioning rail mounted in the groove, said support being of "L" cross-section having a first leg seated with respect to the bottom of the groove and having a second leg presenting an upstanding reference surface interposed between the tensioning rail and the trailing wall of the groove, a set of tensioning springs recessed in the tensioning rail and bearing against the reference surface for applying peripheral tension to the trailing edge of the plate, a latch in the form of a spring detent for latching the tensioning rail temporarily against the reference surface for overcoming the tensioning springs while the trailing edge of the plate is being gripped, adjustable anchoring means for anchoring the support selectively in a series of peripheral positions with respect to the bottom of the groove for accommodation of plates of differing length, the spring detent being mounted upon the support, and means including a plurality of jack screws threaded into the tensioning rail and having tips which bear against the reference surface on the support for moving the tensioning rail away from the reference surface for simultaneously (a) removing slack from the plate and (b) overpowering the spring detent so that the plate tensioning springs are free thereafter to tension the plate about the surface of the cylinder as the press is operated.

8. In a plate cylinder assembly for a printing press and intended for use with a thin flexible printing plate, the combination comprising a plate cylinder formed with a longitudinal groove having a bottom, a leading wall and a trailing wall, a clamping rail at the leading wall, a leading edge clamp attached to the clamping rail for gripping the leading edge of the plate, a tensioning rail at the trailing wall mounted in the longitudinal groove for peripheral movement, a trailing edge clamp attached to the tensioning rail for gripping the trailing edge of the plate, a support for the tensioning rail mounted in the groove, said support being of "L" cross-section having a first leg seated with respect to the bottom of the groove and having a second leg presenting an upstanding reference surface interposed between the tensioning rail and the trailing wall of the groove, a set of tensioning springs recessed in the tensioning rail and bearing against the reference surface for applying periphral tension to the trailing edge of the plate, a latch in the form of a spring detent for latching the tensioning rail temporarily against the reference surface for overcoming the tensioning springs while the trailing edge of the plate is being gripped, adjustable anchoring means for anchoring the support selectively in a series of peripheral positions with respect to the bottom of the groove for accommodation of plates of differeing length, the spring being mounted upon the support, and means including a plurality of jack screws threaded into the tensioning rail and having tips which bear against respective tensioning springs so that upon tightening the jack screws the tensioning rail is increasingly urged away from the reference surface to tension the plate about the surface of the cylinder.

9. The combination as claimed in claim 1 or in claim 2 or in claim 3 or in claim 7 or in claim 8 in which the clamping rail is mounted in the cylinder for peripheral movement, a plurality of jack screws threaded into the clamping rail and having their tips engaging the leading wall of the groove for adjustment of the plate in peripheral register.

10. The combination as claimed in claim 1 or in claim 2 or in claim 3 or in claim 7 or in claim 8 in which the clamping rail is mounted in the cylinder for peripheral movement, a plurality of jack screws threaded into the clamping rail and having their tips engaging the leading wall of the groove for adjustment of the plate in peripheral register, and a return spring for biasing the clamping rail against the leading wall of the groove.

11. The combination as claimed in claim 1 or in claim 2 or in claim 3 or in claim 7 or in claim 8 in which the rails are movable with respect to the cylinder axially through a short distance and in which means are provided for holding each rail in a desired axially-adjusted position thereby to adjust the condition of axial register of the plate.

* * * * *